US007513937B2

(12) United States Patent
Luntz

(10) Patent No.: US 7,513,937 B2
(45) Date of Patent: Apr. 7, 2009

(54) OIL RECONDITIONING DEVICE AND ASSOCIATED METHODS

(75) Inventor: Matthew Luntz, Highland, UT (US)

(73) Assignee: Refined Global Solutions, Inc., Riverton, UT (US)

( * ) Notice: Subject to any disclaimer, the term of this patent is extended or adjusted under 35 U.S.C. 154(b) by 367 days.

(21) Appl. No.: 11/177,733

(22) Filed: Jul. 8, 2005

(65) Prior Publication Data

US 2007/0007199 A1 Jan. 11, 2007

(51) Int. Cl.
*B01D 19/00* (2006.01)

(52) U.S. Cl. ..... 96/193; 96/194; 96/200; 95/266; 196/128; 184/6.24

(58) Field of Classification Search ..... 95/266; 96/193, 194, 200, 201, 203; 210/180, 188; 196/128; 184/6.21, 6.24
See application file for complete search history.

(56) References Cited

U.S. PATENT DOCUMENTS

| | | | | | |
|---|---|---|---|---|---|
| 1,864,095 | A | * | 6/1932 | Rodman et al. | 184/6.21 |
| 1,868,917 | A | * | 7/1932 | Rodman et al. | 184/6.21 |
| 1,870,193 | A | | 8/1932 | Grahame | |
| 2,012,695 | A | * | 8/1935 | Shillaber | 196/128 |
| 2,072,180 | A | * | 3/1937 | Paton | 184/6.4 |
| 2,159,994 | A | | 5/1939 | La Brecque | |
| 2,161,964 | A | | 6/1939 | La Brecque | |
| 2,173,631 | A | | 9/1939 | Niedens | |
| 2,237,253 | A | * | 4/1941 | Rosnell et al. | 184/6.21 |
| 2,268,653 | A | * | 1/1942 | Flowers | 184/6.21 |
| 2,303,261 | A | * | 11/1942 | Dunmire | 184/6.21 |
| 2,324,763 | A | * | 7/1943 | Carruthers | 210/787 |
| 2,336,021 | A | | 12/1943 | Labrecque | |

(Continued)

FOREIGN PATENT DOCUMENTS

| | | |
|---|---|---|
| EP | 295871 | 12/1988 |

(Continued)

OTHER PUBLICATIONS

Published U.S. Appl. No. 11/177,513, filed Jul. 8, 2005, Luntz.

(Continued)

*Primary Examiner*—Duane S Smith
*Assistant Examiner*—Robert A Clemente
(74) *Attorney, Agent, or Firm*—Thorpe North & Western LLP

(57) ABSTRACT

A device and method for reconditioning oil or vaporizing volatile fluids from oil of internal combustion engines in order to extend the oil service life is provided. Such a device can include a housing which defines a substantially enclosed open chamber which can receive heated engine oil. An engine oil inlet, a vapor outlet, and a reconditioned oil outlet may be coupled to the housing. In addition, the disclosed oil reconditioning device may be free of direct heating or supplemental heating sources other than the intrinsic heat of the heated engine oil as it enters the open chamber. The reconditioning devices can be configured to introduce engine oil into the open chamber prior to contact with any interior surfaces. Separation of volatile fluids can be affected using either spraying or thin film. The reconditioned oil has a significant reduction in water and fuel content thus allowing for increased service intervals and increased useful oil life.

12 Claims, 2 Drawing Sheets

U.S. PATENT DOCUMENTS 2,354,352 A * 7/1944 Sharples ..... 184/6.21
2,373,349 A * 4/1945 Serrell ..... 184/6.24
2,373,350 A * 4/1945 Sharples ..... 210/130
2,389,555 A * 11/1945 Sharples ..... 210/149
2,425,377 A 8/1947 La Brecque
2,451,668 A * 10/1948 Egger et al. ..... 208/184
2,500,916 A * 3/1950 Whaley, Jr. ..... 95/250
3,241,677 A * 3/1966 Schmitz ..... 210/180
3,358,424 A * 12/1967 Magorien ..... 96/164
3,581,464 A * 6/1971 Bhuta et al. ..... 95/247
3,616,885 A 11/1971 Priest
3,649,230 A * 3/1972 Moore ..... 48/102 R
3,756,412 A 9/1973 Barrow
3,771,624 A * 11/1973 Forgeron ..... 184/6.24
3,845,751 A * 11/1974 Runstetler ..... 123/196 A
3,859,975 A 1/1975 Hines
3,915,860 A 10/1975 Priest
4,006,084 A 2/1977 Priest
4,093,548 A 6/1978 Sterkenburg et al.
4,115,201 A 9/1978 Malec
4,146,475 A 3/1979 Forsland
4,261,838 A 4/1981 Halleron
4,337,119 A 6/1982 Donahue
4,338,189 A 7/1982 Johnson, Sr.
4,349,438 A 9/1982 Sims
4,369,110 A 1/1983 Picek
4,388,185 A 6/1983 Ott et al.
4,443,334 A 4/1984 Shugarman et al.
4,512,299 A * 4/1985 Egan et al. ..... 123/196 A
4,615,413 A * 10/1986 Stevenson ..... 184/6.4
4,659,347 A * 4/1987 Schrems ..... 96/192
4,717,474 A 1/1988 Sims
4,753,724 A * 6/1988 Womble ..... 210/180
4,758,338 A 7/1988 Johnson, Sr.
4,830,745 A 5/1989 van der Meulen
4,898,668 A 2/1990 Hodgkins et al.
4,933,093 A 6/1990 Keller
4,971,704 A 11/1990 Johnson, Sr.
5,156,747 A 10/1992 Weber et al.
5,171,455 A 12/1992 Wang et al.
5,198,104 A 3/1993 Menyhert
5,211,856 A 5/1993 Shen
5,242,034 A 9/1993 DePaul
5,314,613 A * 5/1994 Russo ..... 208/184
5,315,005 A 5/1994 Russo
5,707,515 A 1/1998 DePaul
5,766,321 A 6/1998 Ishihara et al.
5,824,211 A 10/1998 Lowry
6,083,406 A 7/2000 DePaul et al.
6,139,725 A * 10/2000 Barr et al. ..... 210/90
6,482,467 B2 11/2002 Miyasaka
6,666,968 B2 12/2003 Smith et al.
6,818,046 B1 11/2004 Lowry

FOREIGN PATENT DOCUMENTS

WO WO 80/00222 2/1980

OTHER PUBLICATIONS

U.S. Appl. No. 11/178,088, filed Jul. 8, 2005, Luntz

* cited by examiner

OIL RECONDITIONING DEVICE AND ASSOCIATED METHODS

FIELD OF THE INVENTION

The present invention relates generally to oil reconditioning devices used in internal combustion engines and in particular to devices and methods for the continuous removal of volatile fluids and contaminants, such as water and fuel, found in engine lubricating oil. Accordingly, the present application involves the fields of chemistry, materials science, and thermodynamics.

BACKGROUND OF THE INVENTION

Internal fuel combustion engines are used in a variety of circumstances such as automobiles, marine crafts, aircrafts, locomotives, diesel trucks, stationary diesel engines, to name a few. All internal combustion engines have moving parts which are susceptible to wear and damage during operation due to the presence of foreign material and/or breakdown of engine oil. Engine oils are used to lubricate interfaces or surfaces between the moving parts; however, volatile fluids and contaminants found in engine oils can significantly reduce the useful service life of the oil. Many have realized that engine oils having an extended service life can provide wide spread benefits, therefore attempts have been made to accomplish this purpose.

Generally, a number of methods and approaches have been implemented by those in the industry to extend the engine oil service life. One specific approach has been to formulate oils to include various additives. For example, additives can be designed to reduce or prevent oxidation, neutralize acids, and/or reduce agglomeration of particulates. In addition, specific additives such as viscosity modifiers have also been used to extend the temperature range over which the oils operate thereby improving the service life of the oil. However, such additives typically have a finite period of usefulness until the additive is exhausted or otherwise rendered ineffective.

Another common approach for extending oil service life is to filter the oil in an attempt to remove particulate matter. Typically, full flow particulate filters are utilized to filter particulates to extend service life. These particulate filters have become a standard in internal combustion engines, however, merely removing particulates from engine oil only accounts for a portion of the contaminants. The presence of water and other volatile fluids in lubricating engine oils can also reduce the service life of the oil and can be detrimental to internal engine performance. Moisture or volatile fluids can result in the production of unwanted corrosion and oxidation producing acids and additional particulates.

Previous attempts to develop processes which reduce water content or other volatile fluids from engine oil have been met with varying degrees of success. Some of these processes have utilized heated surfaces in various configurations. The various configurations allow for the surface to be heated by supplemental heat sources or thermal conduction from the heat of the engine oil. Removal or vaporization of volatile fluids in these processes is usually accomplished by forming a thin film of oil over the heated surface. However, these processes are typically inefficient since they often place undesirable electrical loads on the vehicle's electrical system. Further, the complexities of supplemental heating sources can jeopardize the reliability and increase the difficulty of the installation of the device. In the event problems arise with the device, isolating and trouble shooting the problems will require analyzing the extra components provided by the supplemental heating source. In addition, the previous processes can sometimes promote unpredictable and inconvenient environments due to supplemental heating sources which are in direct contact with combustible fluids. Other oil reconditioning processes can direct engine oil past an outer surface of a thin film evaporator. Heat from the passing oil heats the thin film evaporator surface prior to the oil entering the evaporator. Supplemental electrical heating may be avoided in this process, however, the heat transfer may be insufficient for proper separation of the volatile fluids from the engine oil and the design configuration may not provide adequate continuous fluid flow.

Although these devices have improved oil quality and extended service life to some degree, each suffers from problems such as unreliable performance, unpredictable dangerous environments, limited practicality, inefficiency, increased costs, and other deficiencies which prevent their widespread use.

As such, systems and methods offering removal of volatile fluids thereby providing improved oil quality and extended service intervals, and which are suitable for use in practical applications continue to be sought through ongoing research and development efforts.

SUMMARY OF THE INVENTION

Accordingly, the present invention provides devices and methods for removing contaminants such as water and volatile fluids from engine lubricating oil to extend the oil service life. The device provided by the present invention may include a housing which can define a substantially enclosed open chamber which can receive heated engine oil. An engine oil inlet may be coupled to the housing and be in fluid communication with the open chamber to allow the heated engine oil to flow into the open chamber prior to contacting any interior surface. In addition, a vapor outlet may be coupled to the open chamber to allow removal of volatile fluids which are vaporized from the heated engine oil. An oil outlet can be oriented below each of the engine oil inlet and vapor outlet to allow for the recovery of the reconditioned oil. Furthermore, the disclosed oil reconditioning device may be free of direct heating or supplemental heating sources other than the intrinsic heat of the heated engine oil as it enters the open chamber.

In one alternative aspect, a method of reconditioning oil is provided. Such a method may include introducing a pressurized heated engine oil into a substantially enclosed open chamber through an oil inlet. The open chamber may be at a lower pressure than the pressurized heated engine oil to facilitate vaporization of volatile fluids found in the heated engine oil. Typically, the pressure in the open chamber has a pressure that is greater than ambient, and can generally be from about ambient to about 100 psig. In addition, the open chamber may be substantially free of heating other than intrinsic heat from the heated engine oil entering the open chamber. As a result, a significant portion, e.g., typically up to about 90%, of the volatile fluids are vaporized. Once vaporized from the heated oil, the volatile fluids may be vented from the open chamber through a vapor outlet. The resultant oil is a reconditioned oil which has reduced water content and volatile fluids thereby allowing for extended service life. Removing the reconditioned oil can then be accomplished through an oil outlet which may be oriented below each of the oil inlet and vapor outlet. The reconditioned oil can then be recirculated to the engine.

In yet another aspect, a method of producing an oil reconditioning device as recited herein is provided. Such a method may include providing a housing having a predetermined configuration which defines a substantially enclosed open chamber which is capable of retaining a fluid. In addition, an engine oil inlet, a reconditioned oil outlet, and a vapor outlet may be coupled to the housing and may be in fluid communication with the open chamber. The reconditioned oil outlet may be oriented below each of the engine oil inlet and vapor outlet and configured for removal of the reconditioned engine oil.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
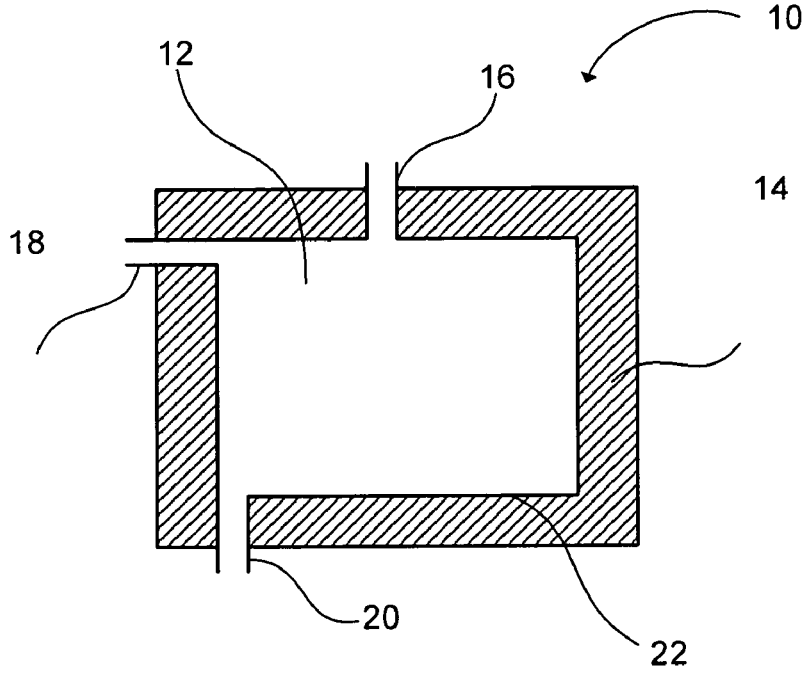
FIG. 1 is a schematic drawing of an oil reconditioning device in accordance with one embodiment of the present invention.

The drawings will be described further in connection with the following detailed description. Further, these drawings are not necessarily to scale and are by way of illustration only such that dimensions and geometries can vary from those illustrated.

DETAILED DESCRIPTION

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "an outlet" includes one or more of such features, reference to "an interior surface" includes reference to one or more of such surfaces, and reference to "a coupling step" includes reference to one or more of such steps.

Definitions

In describing and claiming the present invention, the following terminology will be used in accordance with the definitions set forth below.

As used herein, "reconditioned oil" means an oil that has been restored, improved or purified by at least removing volatile fluids therefrom so as to improve oil performance. The engine oil can be any oil that can be used in an internal combustion engine for lubricating purposes.

As used herein, "volatile fluid" refers to any fluid that can be readily vaporized. Particularly, as used herein, volatile fluid refers to any fluid that has a lower boiling point than engine oil and can functionally be evaporated from the engine oils. Examples of common volatile fluids include water and combustible fuels such as gasoline and diesel.

As used herein, "atomizing" refers to reducing engine oil flow to fine particles, droplets, or a fine spray. Thus, atomizing of the engine oil can significantly increase exposed surface area such that migration of volatile fluids toward droplet surfaces occurs and volatilization thereof are enhanced.

As used herein, "bypass" refers to a process that is configured to treat only a portion of the circulating engine oil. For example, the present invention may be capable of treating about from about 2 vol % to about 40 vol %, and preferably about 10 vol % to about 25 vol % of the total circulating engine oil, although the specific capacity can be designed to accommodate a wide variety of applications.

As used herein, "full flow" refers to processing or filtering substantially all of the total circulating engine oil.

As used herein, "enclosed" refers an area that is substantially or completely surrounded by a housing, which defines an internal space or area, which can be substantially open. Thus, an enclosed area is isolated from ambient conditions by various materials such as housing walls, valves, and the like.

As used herein, "open chamber" refers to a space that is substantially or completely enclosed by a rigid material. In accordance with the present invention, the open chamber may be defined by walls and may have inlets and outlets to form a partially open chamber.

As used herein, "supplemental heating source" refers to any heating source which is used to heat the oil other than the intrinsic heating resulting from passage through the cavities of an operating engine. Examples of supplemental heating sources can include electrical resistive heating elements and the like.

As used herein, "metallic" refers to a metal, or an alloy of two or more metals. A wide variety of metallic materials are known to those skilled in the art, such as aluminum, copper, chromium, iron, steel, stainless steel, titanium, tungsten, etc., including alloys and compounds thereof.

As used herein, "substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context. Similarly, "substantially free of" or the like refers to the lack of an identified element or agent in a composition. Particularly, elements that are identified as being "substantially free of" are either completely absent from the composition, or are included only in amounts which are small enough so as to have no measurable effect on the composition.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

The Invention

The present invention is drawn towards devices and methods that offer an effective and economical option for removing volatile liquid contaminants from lubricating engine oils. Specifically, the present invention can be used to purify and remove volatile contaminant fluids that may cause damage to internal combustion engines.

It should be noted that when referring to items in the figures, certain numerals from one figure to the next denote similar structures. Thus, it is not necessary to re-identify each and every numeral in each figure where a new feature is to be described.

Referring now to FIG. 1, an oil reconditioning device is shown generally at 10 in accordance with one embodiment of the present invention. A housing 14 can be shaped in a desired configuration to define a substantially enclosed open chamber 12. The housing can contain an engine oil inlet 16, a vapor outlet 18, and a reconditioned oil outlet 20 oriented below each of the engine oil inlet and vapor outlet.

Figure 2:
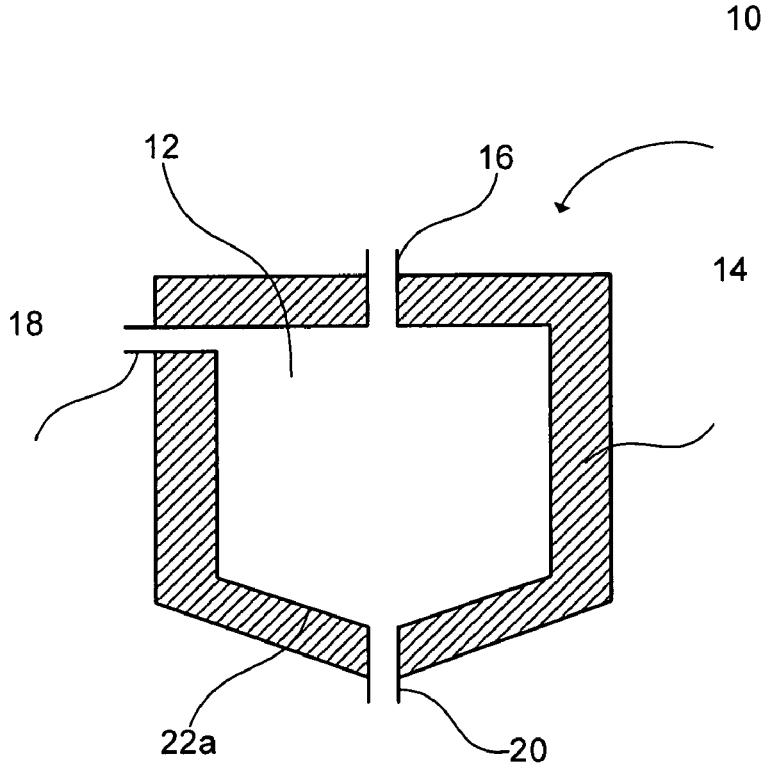
FIG. 2 is a schematic drawing of an oil reconditioning device in accordance with an alternative embodiment of the present invention.

The housing 14 may be formed into any shape that defines a substantially enclosed open chamber 12 that is capable of retaining fluids. Generally, the housing can be formed in a variety of shapes, such as a cylinder, cone, or rectangular chamber. In one aspect, the housing is formed in a rectangular shape having a substantially flat bottom surface 22 as shown in FIG. 1. In an alternative embodiment, the housing is formed in a conical shape as shown in FIG. 2, having a bottom surface 22*a* sloping downward to an oil outlet 20. This sloped configuration can facilitate the removal of reconditioned oil by allowing gravity to pull the reconditioned oil down to and out through the oil outlet.

A variety of rigid materials may be used for the fabrication of housing 14. Preferably, the housing can be fabricated from materials that are capable of retaining fluids and withstanding temperatures up to about 150° C., and preferably up to about 225° C. without deforming. Most of the materials described below operate well above these temperatures; however, the reconditioning device is typically not operated over about 150° C. In addition, the substantially open chamber can be at a lower pressure than the pressurized heated engine oil. Therefore, the housing should also be fabricated from materials that can withstand pressures up to about 100 psig. Specific examples of materials that can be used included without limitation, stainless steel, cast iron, aluminum, plastic, ceramic, and alloys or composites thereof. In some embodiments the housing can comprise or consist of a metallic material. In one embodiment, the metallic material may be aluminum, or an aluminum alloy. In another embodiment, the metallic material may be stainless steel, or a stainless steel alloy. Important considerations when choosing materials include providing materials that have a sufficient rigidity and toughness. Aluminum for example, is easily formable, rigid, light weight, and also cost effective. In another embodiment, the housing can be formed of a ceramic material.

The housing 14 can be formed using any number of techniques such as metal casting, die casting, or machining process, to name a few. In one embodiment, an aluminum housing may be formed by a die casting process. One forming process may be desirable over another depending on the materials being formed into the housing. Notably, the housing can be fabricated so that the chamber is free from heating or supplemental heating (e.g. electrical heating elements) other than intrinsic heat of the heated engine oil. The forming process chosen can account for a design or configuration that allows the housing to be in fluid communication with the open chamber and configured to direct heated engine oil into the open chamber prior to contacting any interior surface. In this way, exposed surfaces of the engine oil can allow for increased effective surface area for removal of volatile fluids.

Additionally, the housing 14 may be insulated with an insulation jacket which decreases heat loss to the surroundings. Alternatively, or in addition to the insulation jacket, the interior or exterior surfaces may be coated with a material which is designed to improve heat transfer to the oil. In one embodiment, the interior surface may be coated with a high performance coating. High performance coatings can include, but are not limited to, ceramics, polymers such as polysiloxanes, epoxies, and the like. Retaining heat of the entering engine oil can further improve the vaporization efficiency by maintaining a higher temperature, thereby facilitating evaporation of volatile fluids as described below.

In one embodiment, the housing 14 can have an engine oil inlet 16 in fluid communication with the chamber 12 thereby providing a passage for introducing engine oil into the substantially open chamber. Most often the engine oil entering the open chamber can have an inlet temperature from about 50° C. to about 150° C., and a pressure from about 25 psig to about 100 psig. However, temperatures and pressures outside these ranges can also be useful, e.g., startup temperatures may be substantially below the above temperature range. Most often, typical engine operating temperatures range from about 90° C. to about 110° C. Typically, the engine oil enters an open chamber through the oil inlet at a flow rate from about 5 gph to about 25 gph. However, it should be kept in mind that the reconditioning devices of the present invention can be sized for larger or smaller applications, e.g., moped engines, large marine vessels, industrial oversized dump trucks, etc. The flow rate of the engine oil may be adjusted to increase or decrease the oil retention time in the chamber. Increasing the retention time may allow the oil additional time to more completely vaporize and separate the volatile fluids from the oil. One method for adjusting the flow rate and separation efficiency can be to couple a spray nozzle to the oil inlet.

There are a number of nozzles that can be coupled to the engine oil inlet 16 which may alter the flow rate and increase the surface area of the entering engine oil. Specific examples of nozzles that can be used included without limitation, a spray nozzle, an atomizing nozzle, a free flowing nozzle, a misting nozzle, to name a few. In one embodiment the spray nozzle coupled to the engine oil inlet can be an atomizing nozzle. Typically, any nozzle that increases the surface area of the entering engine oil can be employed by the present invention. Generally, spray nozzles increase the surface of the engine oil by forming oil droplets. Droplet size, spray pattern and vaporization rate can be altered depending on the nozzle used.

Since volatile fluids are typically at least partially well mixed into the oil, i.e. as a partial solution, emulsion or dispersion, increasing the surface area of the oil can increase the evaporation rate of the volatile fluids. Specifically, the increased surface area facilitates the migration of the volatile fluids to the surface of the oil where they can easily evaporate into the open chamber 12. Therefore, the greater the oil surface area or the more droplets formed, the greater the rate of vaporization of the volatile fluids. For this reason, introducing engine oil into the open chamber through a spray nozzle can be advantageous for increasing the engine oil surface area.

As previously mentioned, various spray patterns may be adapted by spray nozzles to further increase engine oil surface area. Since a variety of open chamber configurations and shapes may be used in accordance with the present invention, spray width, concentration and pattern should be considered when determining the optimal spray pattern for each configuration. Accordingly, the present invention may employ a number of spray patterns which may include without limitation, hollow cone spray, full cone spray, flat spray, fine spray, and air atomizing spray patterns. In one embodiment, the spray pattern may be an air atomizing spray pattern. Generally, any spray pattern may be adjusted such that the surface area of heated engine oil entering the open chamber may be maximized. Depending on the position and configuration of the outlet as described below, the spray pattern can be adjusted for additional retention time within the chamber prior to removal of the reconditioned oil.

Alternatively, the engine oil inlet 16 may be configured to allow direct unimpeded fluid flow into the open chamber 12. Specifically, the engine oil inlet may be substantially free from obstructions or a reduction in aperture size, thereby allowing the heated oil to freely flow uninterrupted into the open chamber. This configuration may be conducive for thin-film evaporation of the heated engine oil. In a thin-film evaporation, the heated engine oil flows over an interior surface as a thin film of oil. As the oil contacts the interior surface, a thin film of oil can be created, thereby increasing the surface area of oil and the evaporation rate of the volatile fluids. Typically, the thin film can be from several microns to about one millimeter in thickness, depending on the flow rate.

The interior surface can be configured to contain various contours that improve the forming of a thin film. The interior surface can include contours which allow for increased retention time as a thin film. For example, the bottom surface of the chamber may be configured to contain a concave or convex surface. As the thin film forms, volatile fluids migrate to the exposed surfaces of the engine oil and are readily vaporized from the heated engine oil into the surrounding environment of the chamber. The resultant oil is a reconditioned engine oil having a reduced or depleted content of volatile fluids. The thin film surface can alternatively have almost any contour which allows for flow of a thin film. Non-limiting examples of contours which can be used include convex, concave, stepped concave, multiple convex surfaces, and the like.

As the volatile fluids become vaporized in the open chamber 12, a vapor outlet 18 can be placed in the housing 14 and configured to allow removal of volatile fluids from the open chamber. Typically, the vapor outlet will be positioned above any outlets 20 that may be coupled to the open chamber. The vapor outlet may be positioned and shaped into any configuration that allows for the volatilized gases to vent from the open chamber. In one embodiment, a plurality of vapor outlets may be coupled to the housing and in fluid communication with the open chamber. As previously noted, once the volatile fluids are vaporized from the engine oil, the resultant oil is collected and removed from the open chamber as a reconditioned oil.

Removal of the reconditioned oil may be accomplished by a reconditioned oil outlet 20 coupled to the housing 14 and in fluid communication with the open chamber 12. The oil outlet provides a passage for the desired oil to exit and return to the engine block or other unit of the engine system. The reconditioned oil outlet is typically oriented below each of the engine oil inlet and vapor outlet. Notably, the reconditioned oil outlet may be coupled to a side wall of the housing. Alternatively, the reconditioned oil outlet may be coupled to a bottom surface of the housing, thereby allowing gravity to remove the reconditioned engine oil as shown in FIG. 2. By orienting the oil outlet below each of the oil inlet 16 and vapor outlet 18 gravity drain can be used to remove the reconditioned oil from the unit 10. Further, problems associated with clogging or blockage of the oil inlet or vapor outlet can be avoided.

Additional features may be included with the present invention to improve the removal of the reconditioned oil from the device. For example, a powered return mechanism can be coupled to the device. Accordingly, the powered return device may be operatively connected to the oil reconditioning device such that reconditioned oil is forced out through the reconditioned oil outlet. Non-limiting examples of powered return mechanisms which can be used include a negative pressure device, a pneumatic float valve, a co-impeller, and an electrical pump. Various means for forcing the reconditioned oil from the reconditioning device can be considered. The above listed powered return mechanisms include the currently preferred means for forcing oil from the reconditioning device.

Further, it has been discovered that using a standard ½" drain line under gravity flow in connection with the present invention can in some embodiments allow air and gas bubbles to be trapped in the line causing blockage. Accordingly, a ¾" or larger line can be used to alleviate this difficulty. Unfortunately, not all engines are equipped with ports of this size. A powered return mechanism such as those described herein can be used to allow use of the standard size line without sacrificing performance.

Incorporating a negative pressure device with the present invention can increase the flow of the reconditioned oil and avoid any clogging or blockage associated with the oil returning to the engine. Typically, the negative pressure device can include a reconditioned oil line fluidly coupled to the reconditioned oil outlet and an oil return line. In this embodiment the reconditioning device may be configured as an oil bypass device, treating only a portion of the total circulating oil and redirect the reconditioned oil to an oil return line, as described below.

Figure 3A:
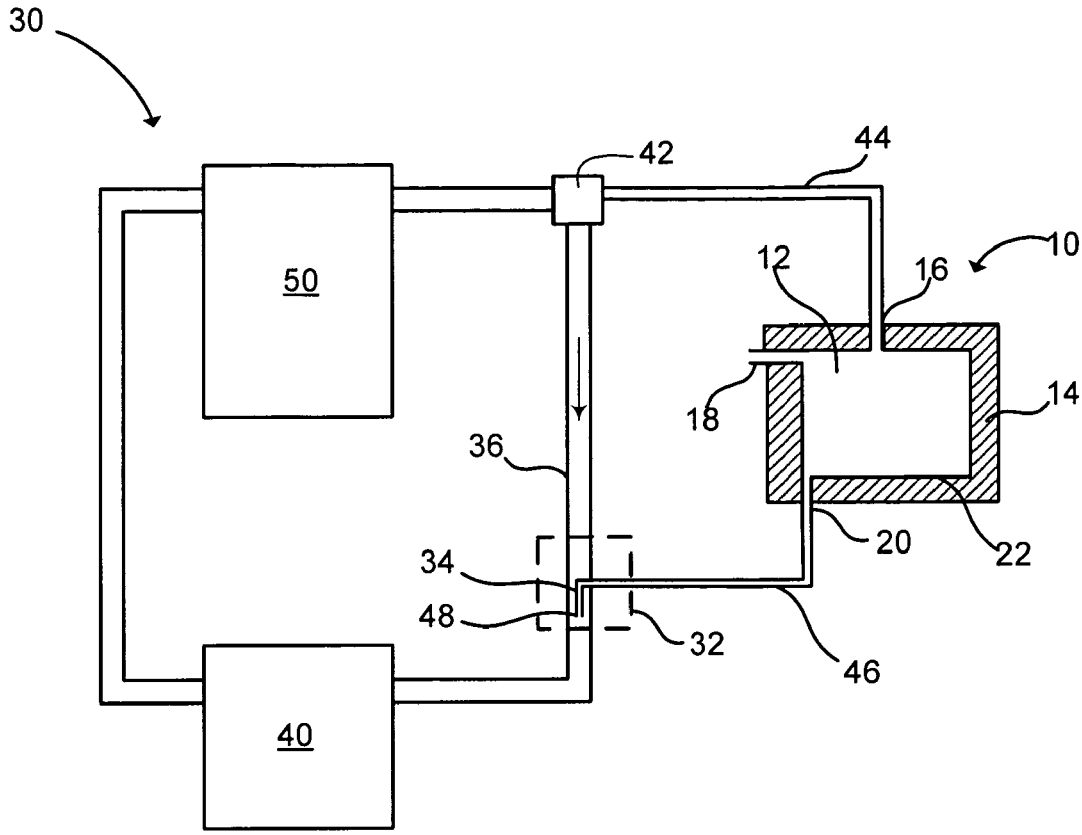
FIGS. 3*a* and 3*b* are schematic drawings of an oil reconditioning device and a powered return mechanism in accordance with an embodiment of the present invention.
Figure 3B:
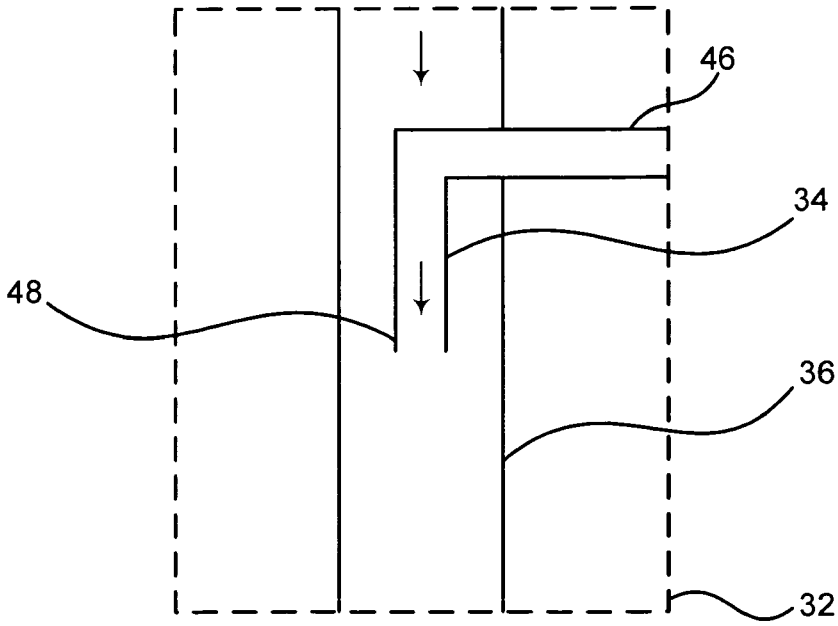

Referring now to FIGS. 3*a* and 3*b*, an engine oil purifying system 30 can include a full flow particulate filter 50 and an oil reconditioning device 10 fluidly coupled. Typically, lubricating oil circulates from an engine 40 to a full flow particulate filter 50. The particulate filter can remove relatively large particulates from the circulating engine oil, as described below. Upon exiting the full flow particulate filter, the engine oil can pass through an oil separator 42, e.g. an open T junction or the like. Generally, the separator is capable of directing a portion of the circulating oil to an oil return line 36 and an oil inlet line 44 fluidly coupled to the engine oil inlet 16 of the oil reconditioning device.

As shown in FIG. 3*a*, the oil flow rate through each of oil return line 36 and oil inlet line 44 can be controlled and or designed to obtain a desired flow rate through the reconditioning device. For example, the reconditioning device may continuously treat from about 2 vol % to about 40 vol % of the total engine oil, and preferably form about 10 vol % to about 25 vol %. The relative oil flow rates can be adjusted by appropriate choice of the diameter of an inlet line connected to the reconditioning device. In one embodiment, the oil inlet line can be fluidly coupled to the engine oil inlet 16 and can have a diameter that corresponds to desired fluid flow. In another embodiment, the engine oil inlet can originate from an engine oil return line and can have a diameter less than the engine oil return line. A smaller diameter can result in a lower oil volume percent being treated and a lower fluid flow rate as compared to the fluid flow rate in the engine oil return line.

The volatile fluids can be removed through a flash vaporization process once the oil enters the open chamber 12, resulting in a reconditioned oil as described herein. The reconditioned oil can then be removed through the use of a pressure differential driven mechanism from the open chamber through the reconditioned oil outlet 20 positioned below the engine oil inlet and the vapor outlet 18. A negative pressure device 32 can include a reconditioned oil return line 46 being fluidly coupled to the reconditioned oil outlet. The reconditioned oil return line can have an end portion 34 distal to the reconditioned oil outlet and which can be concentrically oriented within the oil return line. The end portion can be oriented having an opening 48 thereof directed downstream with the fluid flow from the oil return line. As oil flows past the opening 48, the flowing fluid creates a negative pressure within the reconditioned oil return line 46, thereby increasing the flow and removal of the reconditioned oil from the open chamber. This powered return embodiment is currently preferred over others because of an absence of moving parts or complex designs and do not require connection to pneumatic, electric, or other additional systems.

FIG. 3*b*, illustrates an enlarged view of the negative pressure device 32 having a reconditioned oil return line 46 fluidly coupled to the reconditioned oil outlet and an oil return line 36. Particularly, FIG. 3*b* illustrates the reconditioned oil return line having an end portion 34 distal to the reconditioned oil outlet and being concentrically oriented within the oil return line and oriented having an opening 48 thereof directed downstream.

As previously mentioned, other powered return mechanisms may be utilized in conjunction with the present invention. For example, a co-impeller (not shown) may be coupled to the oil return line 36 and a reconditioned oil return line 46. The co-impeller can be mechanically configured to be a fluid driven assembly. One impeller may be disposed within the oil return line and mechanically coupled to the other impeller disposed in the reconditioned oil return line, e.g. along a common axle. The impeller in the oil return line is driven by the oil as it flows through the line. Because the both impellers are mechanically coupled, the movement of the impeller in the oil return line drives the impeller in the reconditioned oil return line, thereby causing the reconditioned oil flow rate to increase.

Another embodiment of the powered return mechanism can include a pneumatic float valve coupled to the oil reconditioning device. A float valve is positioned in the chamber to contact the reconditioned oil at a predetermined level. Upon contact with the rising reconditioned oil, the float opens a pressurized air valve in the open chamber thereby releasing pressurized air into the chamber. The pressurized air increases the internal pressure of the open chamber and flushes the reconditioned oil out of the chamber and through the reconditioned oil outlet. This embodiment is particularly suited for use in vehicles that utilize a pneumatic system such as, diesel trucks.

In yet another embodiment, the powered return mechanism can be an electric pump fluidly coupled to the reconditioned outlet such that the reconditioned oil may be pumped out of the reconditioned device and back to the oil pan or sump at a predetermined flow rate. An electrical pump can be readily installed in most vehicles directly into the existing vehicle electrical system.

Removal of volatile fluids from the engine oil can be considered at least as important as removing solid particulates from the engine oil such as metal shavings, particle grit, etc. Full flow particulate filters may be used in conjunction with the present invention to filter out these particulates. The full flow filters are typically designed to allow for sufficient oil flow such that the engine is not starved of oil. Generally, the full flow filters are considered primary filters that remove particulates in the range of about 1 micron to about 50 microns from engine oil. The size of the particles filtered is determined largely based upon the filter mesh size. However, as discussed above, these types of full flow filters lack the ability to remove other contaminants such as water, and other volatile fluids. Therefore, it can be advantageous to utilize a full flow particulate filter in conjunction with, or parallel with, a reconditioning device as disclosed herein.

In one embodiment, an oil reconditioning device can be mounted in fluid communication with a full flow particle filter as a single integrated unit. In another embodiment, an oil reconditioning device may be mounted in fluid communication as a separate unit in series with a full flow particle filter. The full flow filter can thus remove particulates from the entering oil stream prior to introduction of the oil into the reconditioning unit. Therefore, the full flow filter can be operatively connected to or positioned upstream from the engine oil inlet.

The reconditioning device 10 as recited herein can be used in a secondary or a bypass configuration such that only a portion of the total engine oil is circulated through the reconditioning device. Alternatively, the reconditioning device can be configured as a full flow reconditioning device. Typically, the reconditioning devices of the present invention can remove from about 85 vol % to about 95 vol % (in a single pass) of volatile fluids from the engine oil, and typically about 90 vol %. Since the devices of the present invention are highly effective at removal of volatile fluids, the device is generally used as a bypass instead of a full flow. A bypass configuration generally works in conjunction and preferably in series with full flow filters. A typical bypass configuration can continuously treat a portion of the total circulating engine oil. In accordance with one aspect of the present invention, the reconditioning device may continuously treat from about 2 vol % to about 40 vol %, and often from about 10 vol % to about 25 vol % of the total engine oil (with 15 vol % being nominal), although other flow rates can be designed depending on the particular engine and intended operating conditions. Reconditioning devices configured in a bypass configuration can purify the engine oil from fluid contaminants such as water and fuel that a conventional full flow particulate filter cannot, to produce an engine oil having an extended service life.

The following example will enable those skilled in the art to more clearly understand benefits of the present invention. It is to be understood that while the invention has been described in conjunction with the preferred specific embodiments thereof, that which follows is intended to illustrate and not limit the scope of the invention. Other aspects of the invention will be apparent to those skilled in the art to which the invention pertains.

EXAMPLE

The following example was conducted to determine the efficiency of removing volatile fluids from engine oil according to one embodiment of the present invention.

The removal of volatile fluids was performed in an oil reconditioning device having a domed shape interior surface and an internal temperature and pressure of approximately 180° F.+/−5° F. and 40 psi, respectively. Lubrication motor oil (J1260 30W) was introduced into the open chamber of the reconditioning device and contacted the domed surface thereby creating a thin film of oil on the domed surface. The volatiles were vaporized from the oil at an efficiency of about 90.0%. The specific amounts of each volatile fluid removed, i.e. diesel fuel and water, was 90.6% and 86.9%, respectively. No supplemental heating elements were utilized during the process of the above recited example.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An oil reconditioning device, comprising:

a) a housing defining a substantially enclosed open chamber;

b) an engine oil inlet in the housing in fluid communication with the open chamber and configured to direct heated engine oil into said open chamber prior to contacting any interior surface;

c) a vapor outlet in the open chamber configured to allow removal of volatile fluids vaporized from said heated engine oil thereby forming a reconditioned oil;

d) a reconditioned oil outlet oriented below each of the engine oil inlet and vapor outlet;

said oil reconditioning device being free of heating other than intrinsic heat from the heated engine oil as it enters the open chamber; and e) a powered return mechanism operatively connected to the device to force the reconditioned oil out the reconditioned oil outlet, said powered return mechanism being a negative pressure device fluidly coupled to the reconditioned oil outlet, said device comprising i) an oil return line; and ii) a reconditioned oil line fluidly coupled to the reconditioned oil outlet and the oil return line, said reconditioned oil line having an end portion distal to the reconditioned oil outlet, said end portion being concentrically oriented within the oil return line and oriented having an opening thereof directed downstream.

2. The device of claim 1, wherein the oil inlet further includes a spray nozzle.

3. The device of claim 1, wherein the oil inlet is configured to allow unimpeded fluid flow.

4. The device of claim 1, wherein the housing comprises a material selected from the group consisting of stainless steel, cast iron, aluminum, plastic, ceramics, and alloys or composites thereof.

5. The device of claim 1, wherein the device is configured for a heated engine oil flow rate from about 5 gph to about 25 gph.

6. The device of claim 1, wherein the device is configured for an inlet line pressure from about 25 to about 100 psig.

7. The device of claim 1, further comprising a particulate filter operatively connected to the engine oil inlet.

8. The device of claim 1, wherein said device is configured for use as an engine oil bypass device capable of treating a portion of total engine oil.

9. The device of claim 8, wherein said portion is from about 10 to about 25 vol % of the total engine oil.

10. The device of claim 1, further comprising a means for forcing the reconditioned oil out of the reconditioned oil outlet.

11. The device of claim 10, wherein the means for forcing is selected from the group consisting of a negative pressure device, a pneumatic float valve, a co-impeller, and an electrical pump.

12. A method of reconditioning oil, comprising introducing heated engine oil into a device as recited in claim 1 and removing reconditioned oil from said device.

* * * * *